US006261959B1

(12) United States Patent
Travis et al.

(10) Patent No.: US 6,261,959 B1
(45) Date of Patent: Jul. 17, 2001

(54) METHOD AND APPARATUS FOR CHEMICALLY-MECHANICALLY POLISHING SEMICONDUCTOR WAFERS

(75) Inventors: Glenn Travis, Sunnyvale; Christopher Pena, Hayward, both of CA (US)

(73) Assignee: Lam Research Corporation

( * ) Notice: Subject to any disclaimer, the term of this patent is extended or adjusted under 35 U.S.C. 154(b) by 0 days.

(21) Appl. No.: 09/540,385

(22) Filed: Mar. 31, 2000

(51) Int. Cl.[7] ..... H01L 21/00

(52) U.S. Cl. ..... 438/692; 156/345; 438/745

(58) Field of Search ..... 438/691, 692, 438/693, 745, 747; 156/345 L, 345 LP; 216/38, 88, 89, 91

(56) References Cited

U.S. PATENT DOCUMENTS

| | | | |
|---|---|---|---|
| 3,753,269 | 8/1973 | Budman | 15/160 |
| 4,318,250 | 3/1982 | Klievoneit et al. | 51/134 |
| 4,720,939 | 1/1988 | Simpson et al. | 51/135 R |
| 4,934,102 | 6/1990 | Leach et al. | 51/50 |
| 5,081,051 | 1/1992 | Mattingly et al. | 437/10 |
| 5,335,453 | 8/1994 | Baldy et al. | 51/67 |
| 5,484,323 | 1/1996 | Smith | 451/10 |
| 5,536,202 | 7/1996 | Appel et al. | 451/285 |
| 5,547,417 | 8/1996 | Breivogel et al. | 451/58 |
| 5,558,568 | 9/1996 | Talieh et al. | 451/303 |
| 5,575,707 | 11/1996 | Talieh et al. | 451/173 |
| 5,593,344 | 1/1997 | Weldon et al. | 451/296 |
| 5,611,943 | 3/1997 | Cadien et al. | 216/88 |
| 5,622,526 | 4/1997 | Phillips | 451/72 |
| 5,643,044 | 7/1997 | Lund | 451/5 |
| 5,655,951 | 8/1997 | Meikle et al. | 451/56 |
| 5,692,947 | 12/1997 | Talieh et al. | 451/41 |
| 5,692,950 | 12/1997 | Rutherford et al. | 451/552 |
| 5,759,918 | 6/1998 | Hoshizaki et al. | 438/692 |
| 5,762,536 | 6/1998 | Pant et al. | 451/6 |
| 5,871,390 | 2/1999 | Pant et al. | 451/5 |
| 5,897,426 | 4/1999 | Somekh | 451/41 |
| 5,899,798 | 5/1999 | Trojan et al. | 451/259 |
| 5,908,530 | 6/1999 | Hoshizaki et al. | 156/345 |
| 5,958,794 | 9/1999 | Bruxvoort et al. | 438/692 |

FOREIGN PATENT DOCUMENTS

| | | |
|---|---|---|
| WO 98/45090 | 10/1998 | (WO) . |
| WO 99/22908 | 5/1999 | (WO) . |

*Primary Examiner*—William Powell
(74) *Attorney, Agent, or Firm*—Brinks Hofer Gilson & Lione

(57) ABSTRACT

An apparatus for chemically-mechanically polishing a semiconductor wafer comprises a receiving surface attached with a frame; a loading mechanism in contact with the receiving surface, the loading mechanism being configured to load measured portions of a wafer-polishing member containing a fixed abrasive onto the receiving surface; a reciprocation device attached with at least a portion of the receiving surface, the reciprocation device being powered to move the receiving surface in a linear, bi-directional motion; and a wafer holder positioned to releasably hold a wafer adjacent to the receiving surface. Methods of chemically-mechanically polishing semiconductor wafers are also provided.

27 Claims, 3 Drawing Sheets

METHOD AND APPARATUS FOR CHEMICALLY-MECHANICALLY POLISHING SEMICONDUCTOR WAFERS

FIELD OF THE INVENTION

The present invention relates to polishing and planarization of semiconductor wafers. More particularly, the present invention relates to method and apparatus for linearly reciprocating a portion of a continuous polishing member to process a semiconductor wafer.

BACKGROUND

Chemical mechanical planarization techniques are used to planarize and polish each layer of a semiconductor wafer. Available CMP systems, commonly called wafer polishers, often use a rotating wafer carrier that brings the wafer into contact with a polishing pad rotating in the plane of the wafer surface to be planarized. A chemical polishing agent or slurry containing microabrasives and surface modifying chemicals is applied to the polishing pad to polish the wafer. The wafer holder then presses the wafer against the rotating pad and is rotated to polish and planarize the wafer. Some available wafer polishers use orbital motion, or a linear belt, rather than a rotating surface to carry the polishing head. One challenge of polishing semiconductor wafers using a disposable polishing pad on the available wafer polishers is that these polishers must be frequently stopped to replace the polishing member after a limited number of uses. Accordingly, there is a need for a method and system of performing CMP that addresses this issue.

SUMMARY

In one aspect of the invention, an apparatus for chemically-mechanically polishing a semiconductor wafer comprises a receiving surface attached with a frame; a loading mechanism in contact with the receiving surface, the loading mechanism being configured to load measured portions of a wafer-polishing member containing a fixed abrasive onto the receiving surface; a reciprocation device attached with at least a portion of the receiving surface, the reciprocation device being powered to move the receiving surface in a linear, bi-directional motion; and a wafer holder positioned to releasably hold a wafer adjacent to the receiving surface.

In another aspect of the invention, a loading mechanism for loading measured portions of a wafer-polishing member containing a fixed abrasive into an apparatus for the chemical-mechanical polishing of semiconductor wafers comprises a polishing member dispensing roller connected with a frame, the polishing member dispensing roller holding a supply of waferpolishing member, and a feeding device in contact with the supply of waferpolishing member, the feeding device configured to move measured portions of the wafer-polishing member onto a receiving surface in the apparatus for the chemical-mechanical polishing of semiconductor wafers.

In another aspect of the invention, a method of polishing semiconductor wafers comprises loading a measured portion of a wafer-polishing member containing a fixed abrasive onto the receiving surface; and reciprocating the receiving surface and wafer-polishing member in a linear, bi-directional motion against the semiconductor wafer.

In another aspect of the invention, an apparatus for chemically-mechanically polishing semiconductor wafers comprises a receiving surface attached to a frame; a loading mechanism in contact with the receiving surface, the loading mechanism being configured to loads discrete sheets of wafer-polishing members containing a fixed abrasive onto the receiving surface; a reciprocation device attached with at least a portion of the receiving surface, the reciprocation device being powered to move the receiving surface in a linear, bi-directional motion; and a wafer holder positioned to releasably hold a wafer adjacent to the receiving surface.

In another aspect of the invention, a loading mechanism for loading discreet sheets of wafer-polishing members containing a fixed abrasive into an apparatus for the chemical-mechanical polishing of semiconductor wafers comprises a supply bin in a frame, the supply bin adapted to contain a plurality of discrete sheets of wafer-polishing members; an automated sheet feeder in contact with the supply bin, the sheet feeder being configured to automatically uptake a first discrete sheet in the supply of discrete sheets and to load the first discreet sheet onto the receiving surface; and an adjustment mechanism in contact with the supply bin and the automated sheet feeder such that the adjustment mechanism adjusts the relative positioning of the automated sheet feeder and the supply of discrete sheets in the supply bin.

In still another aspect of the invention, a method of simultaneously conditioning a measured portion of a wafer-polishing member containing a fixed abrasive and chemically-mechanically polishing a semiconductor wafer comprises a) loading a measured portion of a wafer-polishing member containing a fixed abrasive onto the receiving surface; and b) reciprocating the receiving surface and wafer-polishing member in a linear bi-directional motion against the semiconductor wafer, c) repeating (b) and (c) until the semiconductor wafer is polished and the measured portion of the wafer-polishing member is conditioned.

The present invention provides the foregoing and other features, and the advantages of the invention will become further apparent from the following detailed description of the presently preferred embodiments, read in conjunction with the accompanying drawings. The detailed description and drawings are merely illustrative of the invention and do not limit the scope of the invention, which is defined by the appended claims and equivalents thereof.

DETAILED DESCRIPTION OF THE PREFERRED EMBODIMENTS

There are several preferred embodiments of the method and apparatus for chemically-mechanically polishing semiconductor wafers.

EMBODIMENTS HAVING A CONTINUOUS SUPPLY OF ABRASIVE MATERIAL

Figure 1:
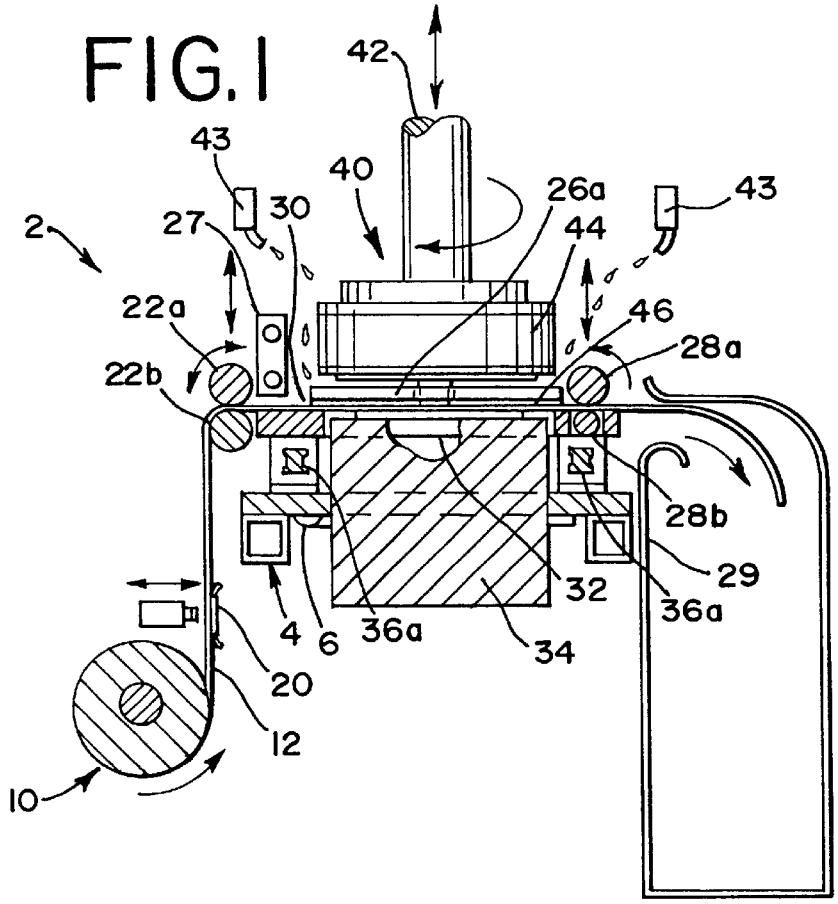
FIG. 1 is a side view of an apparatus for chemically-mechanically polishing a semiconductor wafer.
Figure 2:
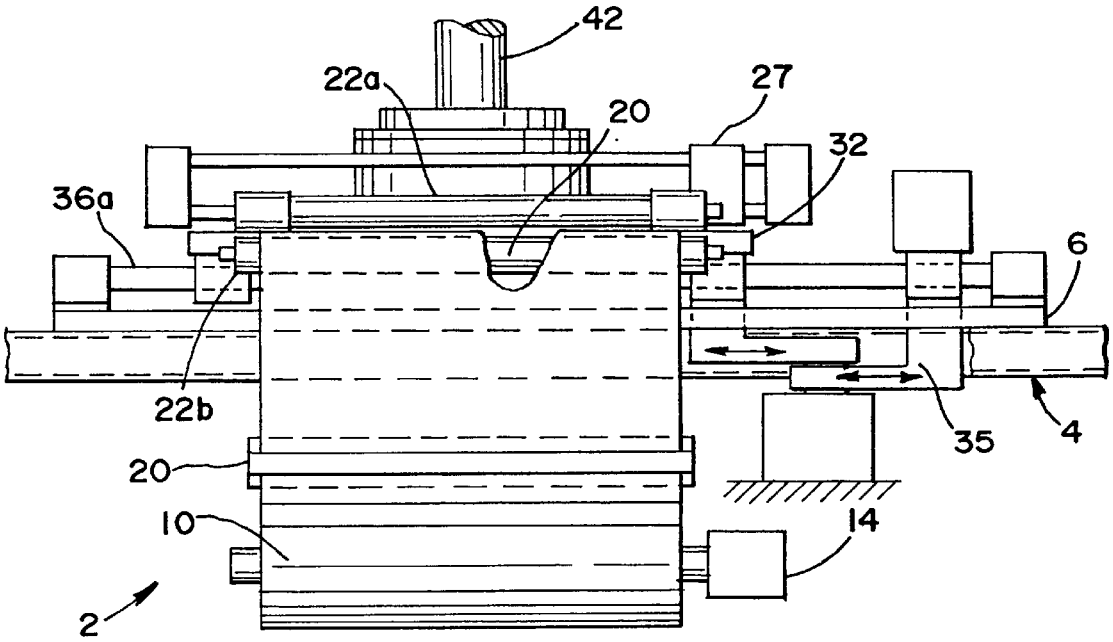
FIG. 2 is a front view of the chemical-mechanical polishing apparatus of FIG. 1.
Figure 3:
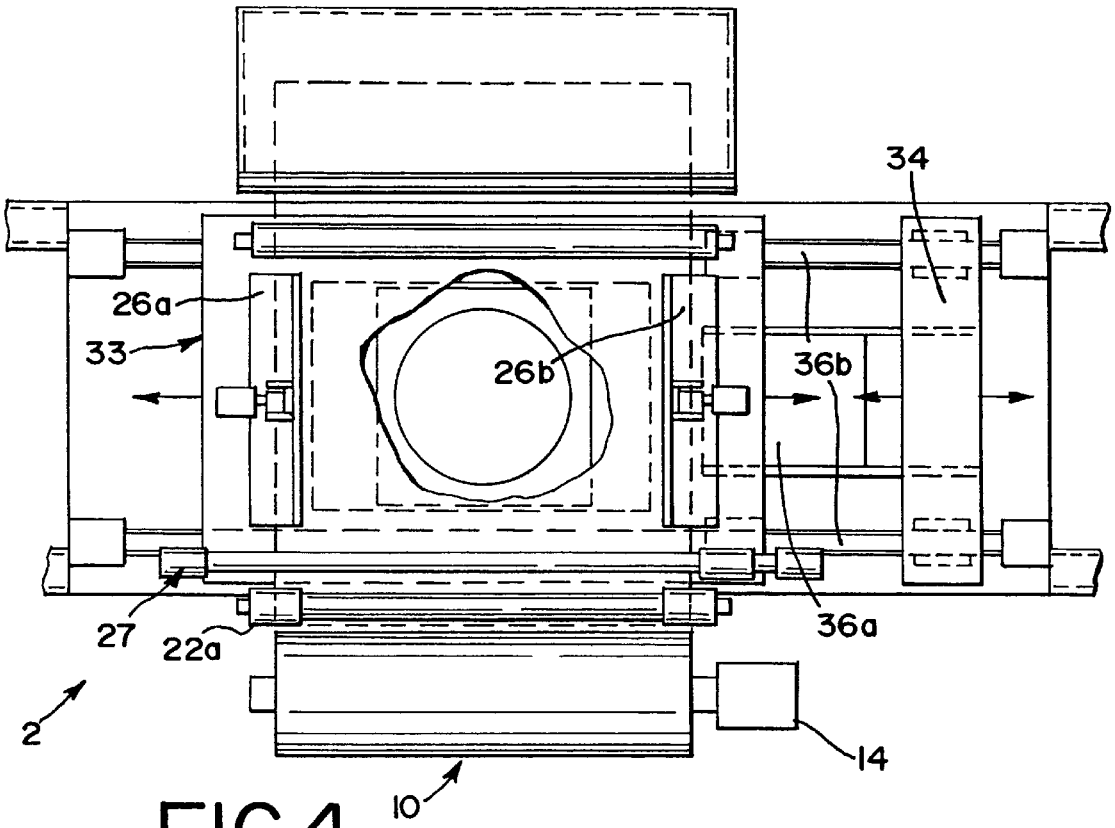
FIG. 3 is a top view of the chemical-mechanical polishing apparatus of FIG. 1.

A preferred embodiment of an apparatus for chemically-mechanically polishing a semiconductor wafer is depicted in FIGS. 1, 2, and 3. The apparatus 2 is built about frame 4 and mounting plate 6.

An abrasive belt feed roll 10 holds a supply of wafer-polishing member 12. A preferred wafer-polishing member comprises a flexible strip having an abrasive layer fixed onto the strip. In one embodiment, the abrasive layer comprises a series of discrete cylindrical abrasive members such that as the abrasive layer becomes worn down through use, the surface area of the discrete cylindrical abrasive members remains substantially constant. The abrasive layer is preferably covered with a protective polymer layer. The polymer layer is removed before the abrasive can be used to polish a semiconductor wafer. This preferred wafer-polishing member is commercially available through the Minnesota Mining and Manufacturing Company as part numbers 3M 307EA and 3M 237AA, which are available in grades A100, A65, A45, A16, and A6.

In another preferred embodiment, the wafer-polishing member comprises a polishing pad adapted to receive an abrasive slurry such as the slurries disclosed in U.S. Pat. Nos. 6,007,407, 6,012,966 and 6,022,266. These patents are incorporated by reference in their entirety. A suitable polishing pad material is commercially available from the Rodel Corporation of Delaware.

Attached to a sidewall of abrasive belt feed roll 10 is belt tension control 14. When belt tension control 14 is off, feed roll 10 is free to rotate. Any known belt tension control mechanism is contemplated for use with this embodiment. The preferred belt tension control 14 can be activated many ways, including but not limited to electronically, pneumatically, hydraulically or a combination.

Although not required, each of the above embodiments described herein may utilize a non-abrasive liquid during polishing, such as deionized water, to facilitate the polishing process. The non-abrasive liquid may be applied via nozzles 43 (See FIG. 1) to the region of the polishing strip intended for contact with a wafer.

Belt conditioner 20 is positioned between belt feed roll 10 and ingress rollers 22*a* and 22*b*. In a preferred embodiment, belt conditioner 20 conditions the wafer-polishing member 12 before polishing member 12 is used to polish a semiconductor wafer. In a preferred embodiment, belt conditioner 20 removes the protective polymer layer from the wafer-polishing member 12. Suitable belt conditioners 20 include, but are not limited to, the conditioners described in U.S. Pat. Nos. 6,022,266, 5,938,507, and 5,934,980, which are hereby incorporated by reference in their entirety. In another preferred embodiment, there is no belt conditioner 20 because the process of polishing occurs simultaneously with the process of conditioning. This is described in greater detail supra in this specification.

Ingress roller 22*a* is powered, and ingress roller 22*b* is not powered. In alternative embodiments, both rollers can be powered or roller 22*b* can be powered while 22*a* is not. Wafer-polishing member 12 is in contact with belt conditioner 20 and ingress rollers 22*a* and 22*b*. In the depicted embodiment, wafer-polishing member 12 frictionally fits between ingress rollers 22*a* and 22*b*. These rollers move wafer-polishing member 12 onto a receiving surface 30. That is, through ingress rollers 22*a* and 22*b*, a measured portion of wafer-polishing member 12 is pulled from feed roll 10 onto receiving surface 30.

Referring to FIG. 3, clamps 26*a* and 26*b* secure the measured portion of wafer-polishing member 12 onto receiving surface 30. Clamps are merely an exemplary securing mechanism. Any securing mechanism known in the art could be used to secure wafer-polishing member 12 onto receiving surface 30.

Receiving surface 30 has an ingress side and an egress side. In a preferred embodiment, belt cutter 27 is positioned above receiving surface 30 on the ingress side. In another preferred embodiment, belt cutter 27 is positioned above receiving surface 30 on the egress side. The position of the belt cutter 27 determines how much of the chemical mechanical polishing assembly oscillates with receiving surface 30 along guide rails 36*a* and 36*b* when polishing occurs. Reciprocating table 32 is attached to reciprocation drive assembly 35. Preferred drive assemblies 35 include a crank shaft, drive motor, connecting rods, and a counter balance. A preferred drive assembly reciprocates linearly (+/−one inch) at an adjustable frequency of from about 0 to about 25 Hertz.

Reciprocating table 32 reciprocates in guide rails 36*a* and 36*b*. It is preferred that the guide rails have linear bearings.

When the belt cutter 27 is on the ingress side of receiving surface 30, as shown, the moving parts include clamps 26*a* and 26*b*, egress roller 28*b*, driven portions of reciprocation drive assembly 35 that impart reciprocation motion onto reciprocated table 32 and counterweight 34. When the belt cutter is on the egress side of receiving surface 30, the following additional parts move with receiving surface 30: feed roll 10, belt tension control 14, ingress rollers 22*a* and 22*b*, and egress roller 28*a*.

Egress rollers 28*a* and 28*b* are in contact with wafer-polishing member 12 on the egress side of receiving surface 30. Egress roller 28*a* is powered, and egress roller 28*b* is not powered. In other embodiments, both rollers may be powered or roller 28*b* may be powered while roller 28*a* is not. Belt disposal container 29 is positioned to receive spent measured portions of wafer-polishing member 12 from egress rollers 28*a* and 28*b*. Any container or disposal mechanism known to those of skill in the art for disposing of spent measured portions of wafer-polishing member 12 is contemplated for use in this embodiment.

In a preferred embodiment, receiving surface 30 comprises reciprocating table 32 positioned above air-bearing platen assembly 34.

Platen assemblies contemplated for use with this embodiment can be any known platen assembly, including but not limited to the platen assemblies disclosed in U.S. Pat. Nos. 5,558,568, 5,985,093, 6,000,997, 6,015,499 and 6,015,506, which are hereby incorporated by reference. Other acceptable platens are those commercially available from the Lam Research Corporation of Fremont, California, including the ones with the trade name TERES. Note that some of these platens are rotating platen assemblies. The platen assemblies contemplated for use with this embodiment are preferably not rotating.

Wafer holder 40 comprises spindle 42 and carrier head 44. Carrier head 44 releasably holds wafer 46. During polishing, wafer 46 is pressed against wafer-polishing member 12 by the wafer holder 40. Spindle 42 rotates carrier head 44 and wafer 46 about an axis perpendicular to receiving surface 30 as wafer polishing member 12 reciprocates with reciprocating table 32 along guide rails 36*a* and 36*b*. In another preferred embodiment, wafer holder 40 does not rotate wafer 46, but instead holds wafer 46 stationary while polishing member 12 reciprocates with reciprocating table 32 along guide rails 36*a* and 36*b*.

In a preferred embodiment using the apparatus described in FIGS. 1, 2, and 3, the method works as follows. A supply of wafer polishing member 12 is kept on belt feed roll 10.

The belt conditioner 24 conditions the wafer-polishing member 12 as it is drawn off of the feed roll so that it is ready to polish wafer 46. After being conditioned, a measured portion of the wafer polishing member 12 is fed through ingress rollers 22*a* and 22*b*, then secured to receiving surface 30 with clamps 26*a* and 26*b*. This measured portion is preferably about 8 inches in length. Then, belt cutter 27 cuts the measured portion of wafer polishing member 12, separating the wafer polishing member from the remainder of the belt feed roll 10. Then, the reciprocation drive assembly reciprocates the receiving surface 30, and all the parts attached therewith reciprocate along guide rails 36*a* and 36*b*.

In the meantime, wafer holder 40, which is holding wafer 46, is brought into contact with the measured portion of polishing member 12. Wafer holder 40 spins about an axis perpendicular to receiving surface 30 while polishing member 12 reciprocates with the receiving surface. Wafer 46 is polished by the combination of spinning and reciprocating. When polishing is complete, the measured portion of polishing member 12 is taken through egress rollers 28*a* and 28*b*, and is discarded into disposal container 29.

In the alternative preferred embodiment wherein the belt cutter is on the egress side of receiving surface 30, belt conditioner 20 is omitted. The alternative apparatus works as follows. A supply of wafer polishing member 12 is kept on belt feed roll 10. A measured portion of the wafer polishing member 12 is fed through ingress rollers 22*a* and 22*b*, then secured to receiving surface 30 with clamps 26*a* and 26*b*. This measured portion is small, preferably less than one inch in length, more preferably less than one-half inch, and most preferably about ¼ inch. Then, the receiving surface 30 and all the parts attached therewith reciprocate along guide rails 36*a* and 36*b*. Wafer holder 40, which is holding wafer 46, is in contact with the measured portion of polishing member 12. Wafer holder 40 spins about an axis perpendicular to receiving surface 30 while polishing member 12 reciprocates with the receiving surface. Wafer 46 is polished at the same time the wafer is conditioned by the combination of spinning and reciprocating. When the first small measured portion is complete, the next small measured portion is pulled onto receiving surface 30 and the reciprocation process is repeated. This occurs until the entire wafer 46 is polished and the polishing member 12 is conditioned. Once a measured portion of polishing member 12 has been conditioned, small or otherwise, it is preferably used to polish more than one wafer 46.

When polishing and conditioning of a wafer 46 is complete, the belt cutter 27 cuts off the spent portion of polishing member 12. Then, the measured portion of polishing member 12 is taken through egress rollers 28*a* and 28*b*, and is discarded into disposal container 29. Any mechanism for disposing of spent polishing member is within the scope of the described embodiment. Such mechanisms include but are not limited to take-up rollers.

EMBODIMENTS USING DISCREET SHEETS OF ABRASIVE MATERIAL

In another preferred embodiment, an apparatus for chemically-mechanically polishing semiconductor wafers has an improved loading mechanism for loading discrete sheets of polishing member 12 onto a receiving surface 30.

Figure 4:
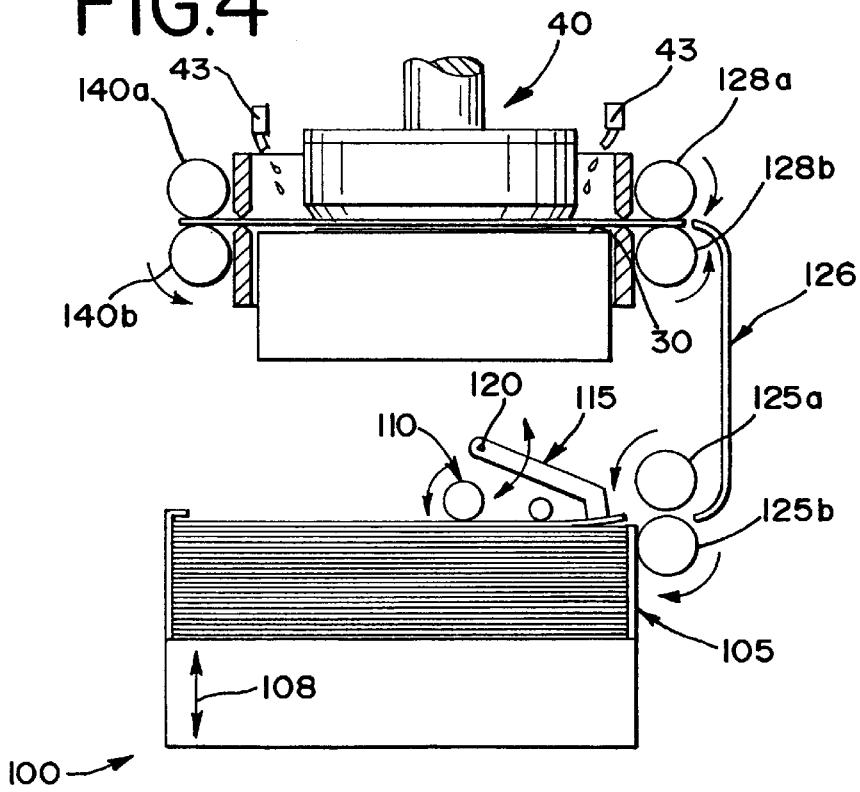
FIG. 4 is a side view of a loading mechanism and the chemical-mechanical polishing apparatus for which the loading mechanism is used.
Figure 5:
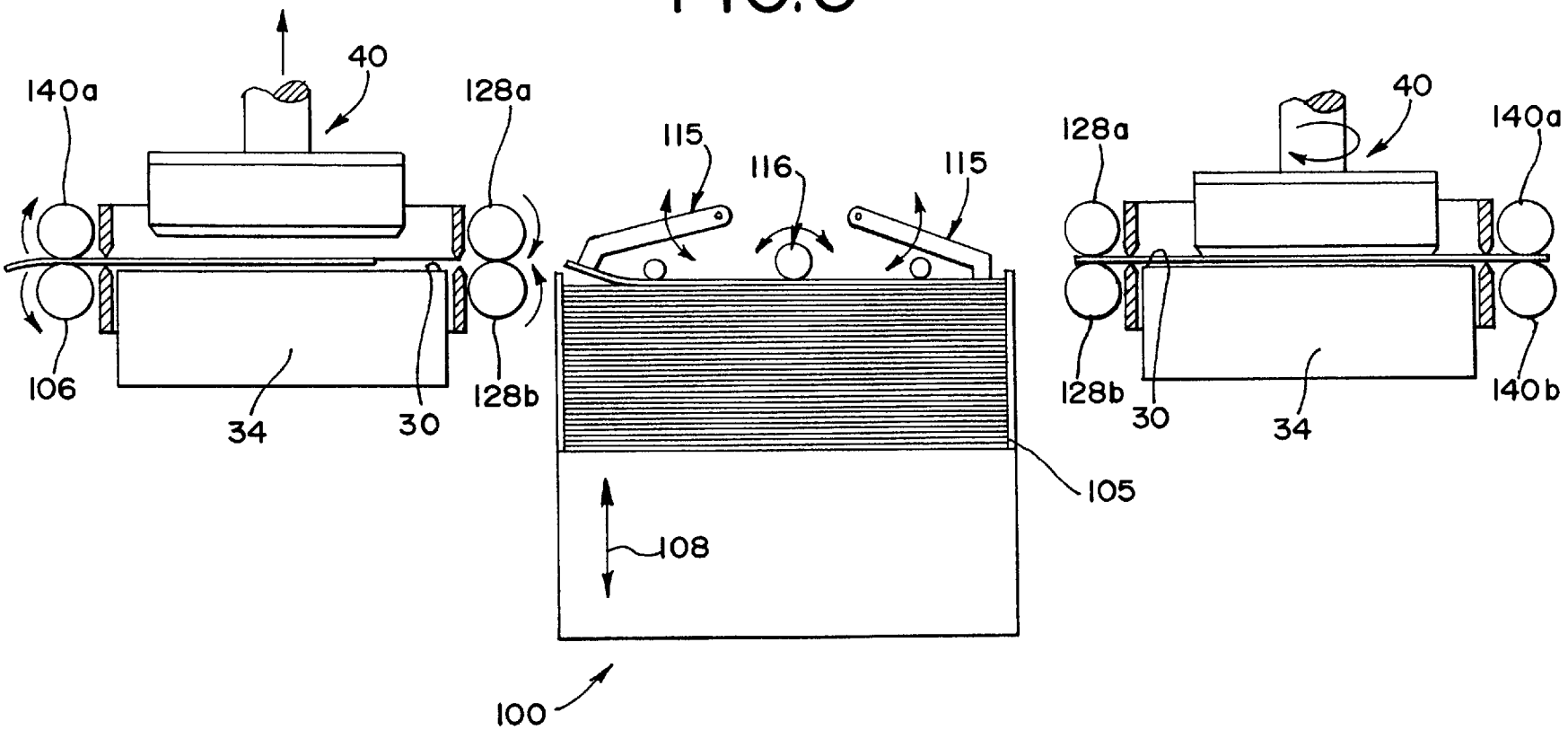
FIG. 5 is a side view of a loading mechanism and the chemical-mechanecal polishing apparatus for which the loading mechanism is used.

Referring to FIGS. 4 and 5, two embodiments of a loading mechanism are shown. In FIGS. 4 and 5, loading mechanism 100 is shown. Supply bin 105 contains a supply of discrete sheets of polishing member 12. Feed roll 110 makes a first discrete sheet available to a web pick up vacuum member 115. In the embodiment depicted in FIG. 4, there is only one web pick up vacuum member 115. In the embodiment depicted in FIG. 5, there are two web pick up vacuum members 115.

Vacuum member 115 is attached to a frame at a pivot point 120. Vacuum member 115 makes contact with a discreet sheet of polishing member 12, rotates about the pivot point 120, and delivers the discreet sheet of polishing member 12 to transfer rollers 125*a* and 125*b*. Then, in FIG. 4, the discreet sheet of polishing member 12 is slid along web transfer guide 126 where it is fed to ingress rollers 128*a* and 128*b*. In FIG. 5, no transfer guide 126 is shown, but such a guide is optional and can be included in the assembly.

After the first discreet sheet of polishing member 12 is removed from the supply bin 105, the supply bin's position is adjusted using any indexing mechanism known to those of skill in the art. Exemplary non-limiting indexing mechanisms are disclosed in U.S. Pat. Nos. 4,248,413, 4,807,868, and 5,013,026. These patents are hereby incorporated by reference.

In these embodiments, it is preferred that the discreet sheets of polishing member 12 be durable enough to remain undamaged while being stacked in a pile and being handled by several sets of rollers and a vacuum member 115. To achieve such a durable set of discreet sheets of polishing member 12, it is preferred that the abrasive be a fixed abrasive as described above.

SCOPE

It should be appreciated that the apparatus of the present invention is capable of being incorporated in the form of a variety of embodiments, only a few of which have been illustrated and described above. The invention may be embodied in other forms without departing from its spirit or essential characteristics. For example, the embodiments of the present invention may be modified to include a linear motor drive. The described embodiments are to be considered in all respects only as illustrative and not restrictive, and the scope of the invention is therefore indicated by the appended claims rather than by the foregoing description. All changes that come within the meaning and range of equivalency of the claims are embraced to be within their scope.

What is claimed is:

1. An apparatus for chemically-mechanically polishing a semiconductor wafer, comprising:

a receiving surface attached with a frame;

a loading mechanism in contact with the receiving surface, the loading mechanism being configured to load measured portions of a wafer-polishing member containing a fixed abrasive onto the receiving surface;

a reciprocation device attached with at least a portion of the receiving surface, the reciprocation device being powered to move the receiving surface in a linear, bi-directional motion; and a wafer holder positioned to releasably hold a wafer adjacent to the receiving surface.

2. The apparatus of claim 1 wherein the loading mechanism comprises:

a polishing member dispensing roller connected with the frame, the polishing member dispensing roller holding a supply of wafer-polishing member, and a feeding device in contact with the supply of wafer-polishing member, the feeding device configured to move measured portions of the wafer-polishing member onto the receiving surface.

3. The apparatus of claim 2 wherein the polishing member dispensing roller is motorized.

4. The apparatus of claim 1 wherein the reciprocation device is attached with both the receiving surface and the loading mechanism.

5. The apparatus of claim 1 wherein the wafer holder is rotatable about an axis perpendicular to the receiving surface.

6. The apparatus of claim 1 further comprising a securing device attached with the frame that releasably secures the measured portion of the wafer-polishing member onto the receiving surface.

7. The apparatus of claim 1 further comprising a cutting device attached with the frame, the cutting device being positioned opposite the receiving surface, wherein cutting activity occurs against the receiving surface.

8. The apparatus of claim 1 further comprising a polishing member conditioner attached with the frame, the polishing member conditioner being positioned between the loading mechanism and the receiving surface.

9. A loading mechanism for loading measured portions of a wafer-polishing member containing a fixed abrasive into an apparatus for the chemical-mechanical polishing of semiconductor wafers, comprising:

a polishing member dispensing roller connected with a frame, the polishing member dispensing roller holding a supply of wafer-polishing member, and a feeding device in contact with the supply of wafer-polishing member, the feeding device configured to move measured portions of the wafer-polishing member onto a receiving surface in the apparatus for the chemical-mechanecal polishing of semiconductor wafers.

10. The loading mechanism of claim 9 wherein the polishing member dispensing roller is motorized.

11. In an apparatus for chemically-mechanically polishing a semiconductor wafer comprising a receiving surface attached with a frame, a loading mechanism in contact with the receiving surface, the loading mechanism being configured to load measured portions of a wafer-polishing member containing a fixed abrasive onto the receiving surface, a reciprocation device attached with at least a portion of the receiving surface, the reciprocation device being powered to move the receiving surface in a linear, bi-directional motion, and a wafer holder positioned to releasably hold a wafer adjacent to the receiving surface, a method of polishing semiconductor wafers comprising:

a) loading a measured portion of a wafer-polishing member containing a fixed abrasive onto the receiving surface; and b) reciprocating the receiving surface and wafer-polishing member in a linear, bi-directional motion against the semiconductor wafer.

12. The method of claim 11 further comprising conditioning the measured portion of the wafer-polishing member before loading the measured portion of the wafer-polishing member onto the receiving surface.

13. The method of claim 11 further comprising securing a measured portion of the wafer-polishing member onto the receiving surface after loading the measured portion of the wafer-polishing member onto the receiving surface.

14. The method of claim 11 wherein the loading mechanism reciprocates with the receiving surface and the measured portion of the wafer-polishing member.

15. The method of claim 11 wherein the loading mechanism remains stationary while the receiving surface and the measured portion of the wafer-polishing member reciprocate.

16. The method of claim 11 further comprising cutting the measured portion of the wafer-polishing member from the remainder of the strip.

17. The method of claim 16 wherein the cutting occurs after (b) and before (c).

18. The method of claim 16 wherein the cutting occurs after (c).

19. An apparatus for chemically-mechanically polishing semiconductor wafers, comprising:

a receiving surface attached to a frame;

a loading mechanism in contact with the receiving surface, the loading mechanism being configured to loads discrete sheets of wafer-polishing members containing a fixed abrasive onto the receiving surface;

a reciprocation device attached with at least a portion of the receiving surface, the reciprocation device being powered to move the receiving surface in a linear, bi-directional motion; and a wafer holder positioned to releasably hold a wafer adjacent to the receiving surface.

20. The apparatus of claim 19 wherein the loading mechanism comprises:

a supply bin connected with frame, the supply bin being sized to contain a supply of discrete sheets of wafer-polishing members;

an automated sheet feeder in contact with the supply bin, the sheet feeder being configured to automatically uptake a first discrete sheet in the supply of discrete sheets and to load the first discreet sheet onto the receiving surface; and an adjustment mechanism in contact with the supply bin and the automated sheet feeder such that the adjustment mechanism adjusts the relative positioning of the automated sheet feeder and the supply of discrete sheets in the supply bin.

21. The apparatus of claim 20 wherein the supply bin is accessible for adding a supply of discrete sheets thereto without interrupting the chemical-mechanical polishing process.

22. The apparatus of claim 20 wherein the reciprocation device is attached with both the receiving surface and the loading mechanism.

23. The apparatus of claim 19 wherein the wafer holder is rotatable about an axis perpendicular to the receiving surface.

24. The apparatus of claim 19 further comprising a securing device attached with the frame that releasably secures the measured portion of the wafer-polishing member onto the receiving surface.

25. The apparatus of claim 19 further comprising a polishing member conditioner attached with the frame, the polishing member conditioner being positioned between the loading mechanism and the receiving surface.

26. A loading mechanism for loading discreet sheets of wafer-polishing members containing a fixed abrasive into an apparatus for the chemical-mechanecal polishing of semiconductor wafers, comprising:

a supply bin in a frame, the supply bin adapted to contain a plurality of discrete sheets of wafer-polishing members;

an automated sheet feeder in contact with the supply bin, the sheet feeder being configured to automatically uptake a first discrete sheet in the supply of discrete sheets and to load the first discreet sheet onto the receiving surface; and an adjustment mechanism in contact with the supply bin and the automated sheet feeder such that the adjustment mechanism adjusts the relative positioning of the automated sheet feeder and the supply of discrete sheets in the supply bin.

27. In an apparatus for chemically-mechanically polishing a semiconductor wafer comprising a receiving surface attached with a frame, a loading mechanism in contact with the receiving surface, the loading mechanism being configured to load measured portions of a wafer-polishing member containing a fixed abrasive onto the receiving surface, a reciprocation device attached with at least a portion of the receiving surface, the reciprocation device being powered to move the receiving surface in a linear, bi-directional motion, and a wafer holder positioned to releasably hold a wafer adjacent to the receiving surface, a method of simultaneously conditioning a measured portion of a wafer-polishing member containing a fixed abrasive and chemically-mechanically polishing a semiconductor wafer comprising:

a) loading a measured portion of a wafer-polishing member containing a fixed abrasive onto the receiving surface; and b) reciprocating the receiving surface and wafer-polishing member in a linear bi-directional motion against the semiconductor wafer, c) repeating (b) and (c) until the semiconductor wafer is polished and the measured portion of the wafer-polishing member is conditioned.

* * * * *

UNITED STATES PATENT AND TRADEMARK OFFICE

CERTIFICATE OF CORRECTION

PATENT NO. : 6,261,959 B1
DATED : July 17, 2001
INVENTOR(S) : Glenn Travis et al.

It is certified that error appears in the above-identified patent and that said Letters Patent is hereby corrected as shown below:

Claim 9,
Line 12, delete "chemical-mechanecal" and substitute -- chemical-mechanical -- in its place.

Claim 26,
Line 3, delete "chemical-mechanecal" and substitute -- chemical-mechanical -- in its place.

Signed and Sealed this

Ninth Day of April, 2002

*Attest:*

*Attesting Officer*

JAMES E. ROGAN
*Director of the United States Patent and Trademark Office*